United States Patent [19]

Lund

[11] 4,244,672

[45] Jan. 13, 1981

[54] SYSTEM FOR SEQUENCING ARTICLES INCLUDING MAIL

[75] Inventor: George E. Lund, Berwyn, Pa.

[73] Assignee: Burroughs Corporation, Detroit, Mich.

[21] Appl. No.: 45,438

[22] Filed: Jun. 4, 1979

[51] Int. Cl.[3] ..... B65G 43/00

[52] U.S. Cl. ..... 414/134; 198/358; 246/5

[58] Field of Search ..... 414/134–136; 246/4, 5, 2 S, 63 R, 63 C, 122 R, 167 R; 104/88; 198/347, 349, 350, 357, 358, 363, 366, 370; 364/478

[56] References Cited

U.S. PATENT DOCUMENTS

| | | | |
|---|---|---|---|
| 3,214,003 | 10/1965 | Wilson | 198/350 |
| 3,573,748 | 4/1971 | Holme | 414/134 X |
| 3,610,159 | 10/1971 | Fickenscher | 104/88 |
| 3,757,939 | 9/1973 | Henig | 414/134 X |
| 3,884,370 | 5/1975 | Bradshaw et al. | 414/134 |
| 4,053,741 | 10/1977 | Ainoya et al. | 198/347 X |
| 4,058,217 | 11/1977 | Vaughan et al. | 414/136 X |
| 4,106,636 | 8/1978 | Ouimet et al. | 414/134 |

*Primary Examiner*—Stephen G. Kunin
*Assistant Examiner*—T. L. Siemens
*Attorney, Agent, or Firm*—Francis A. Varallo; Leonard C. Brenner; Kevin R. Peterson

[57] ABSTRACT

A system is provided for arranging articles in a predetermined sequence. In mail handling applications, the documents destined for local distribution may be segregated as to the respective routes of the postmen and arranged in sequence within each route in accordance with the mail-stops or street addresses. In such a system, the documents are transported by individual mechanical carriers. Temporary high density storage of the documents is provided by a recirculation buffer subsystem. Based upon system priorities, selected carriers may be taken out of buffer storage, independently of the other carriers. The selected carriers are then circulated in a short transit-time loop from which they exit to one or more output racks, where they appear in sequential order.

10 Claims, 3 Drawing Figures

SYSTEM FOR SEQUENCING ARTICLES INCLUDING MAIL

CROSS REFERENCE TO RELATED APPLICATIONS

The present application is closely related to two U.S. patents, namely, U.S. Pat. No. 3,884,370, which issued from application Ser. No. 401,954, entitled "System for Sorting and Processing Articles Including Flat Mail Pieces" by Robert S. Bradshaw et al. and U.S. Pat. No. 4,106,636, entitled "Recirculation Buffer Subsystem for use in Sorting and Processing Articles Including Mail Flats", which issued from application Ser. No. 744,613 in the names of Raymond J. Ouimet, et al. Both of the above referenced patents are assigned to the same assignee as the present application.

BACKGROUND OF THE INVENTION

In the referenced Bradshaw et al. patent, there is described and claimed a system for sorting articles of varying physical characteristics, including machinable mail flats. In operation, the incoming mail flats are clipped to a carrier device at an induction station and subsequently the carrier's magnetic stripe is encoded with a destination code based, for example, on the ZIP code. The flat then enters a conveyor distribution system which reads the escort memory data on the carrier's stripe and directs the flat via appropriate gating to a storage destination or output accumulation rack to await further sorting or outputting from the system. Such a system requires a sizable space allocation to accommodate the large numbers of storage locations.

The recirculation buffer subsystem described and claimed in the Ouimet et al. patent provides a solution to the storage space problem which directs itself to small and medium size Post Offices. Thus, in accordance with the last mentioned patent, one or more recirculating buffers are incorporated between the induction stations and the output accumulation racks of the aforementioned Bradshaw et al. system. The recirculating buffer offers a means of temporarily storing flats on carriers such that any flat may be taken out of storage independently of any other. This is accomplished by providing a closed serpentine conveyor path such that all flats are continuously moving. If a specific flat is requested, the carrier and the flat attached thereto are caused to exit the buffer after passing a reader which identifies the flat in accordance with the destination data stored on the carrier escort memory. A record is kept by the system computer of the data associated with all of the flats in the buffer in order that control may be provided. The computer functions to maintain a balance between output and input and provides to the output packaging, or traying subsystem, the most productive stack sizes available in the system. This is accomplished through the establishment of a hierarchy of priorities, such as the flat count or stack thickness per destination.

In addition to the basic sorting function required in mail-handling applications, a sequencing operation in which items are placed in sequence order, assumes primary importance. In the past, sequencing has often involved time-consuming and inefficient methods. The present invention expands upon the recirculation buffer subsystem of the Ouimet et al. patent to provide an effective, high-speed sequencing capability.

SUMMARY OF THE INVENTION

In accordance with the present invention, sequencing is performed by utilizing a reentrant connection of the secondary carrier transport which accepts the outputs of the recirculating buffers. Such a connection creates a loop which has a short transit-time as compared with the cycle time of the recirculating buffers. Many of the system details disclosed in the Bradshaw et al. and Ouimet et al. patents are pertinent to the present invention, and these should be considered incorporated herein by reference.

In performing its sequencing function, the system assumes that the incoming documents destined for local distribution include on their respective carrier escort memories, information as to the postman's route and the sequence within the route, such as the mail-stop or street address, as well as the document thickness. This last information is required because of space limitations in the individual output accumulation racks and the trays into which the stacks of documents are eventually deposited.

As in the Ouimet et al. patent, the documents bound for various routes are circulated intermixed in the recirculating buffers. Each of the latter comprises a serpentine path of considerable overall length, adapted to store a large population of documents bound for many route destinations. A record is kept by the system computer of the data associated with each document. In accordance with predetermined priorities, the computer determines which route numbers will be sequenced, and the documents associated therewith are withdrawn from the recirculating buffers. The latter documents then enter the secondary transport loop.

The transit-time of a cycle of the recirculating buffer is a function of the number of documents being stored in the buffer. As such, a single cyle or excursion of the documents around a recirculating buffer for the purpose of exiting documents for a selected destination, may involve a considerable time period. On the other hand, the primary function of the secondary transport loop is the sequencing of documents belonging to the selected destinations and not the bulk storage of many documents provided by the recirculating buffers. Also, the sequencing operation normally entails repetitive cycles of operation as the documents are placed in order, even when all of the documents in the secondary transport are destined for a single postman's route. For these reasons, and to insure maximum system throughput, the path traversed by the documents in the secondary transport loop is made considerably shorter than that of a recirculating buffer and the transit-time in the former loop is therefore significantly less.

Utilizing computer carrier management tables, the read station of the secondary transport loop identifies the output accumulation rack and order within the rack for each document. At this time a decision is made as to whether a given document should be diverted to an output rack to build the desired sequence or allowed to proceed around the loop for a subsequent attempt at building the sequence. Ultimately, the route sequence is built up in a single output rack or segments of the sequence are placed in a respective plurality of racks. Sweeping of the sequential documents is then performed and they are outputted from the system.

Other features and advantages of the present system will become apparent in the detailed description which follows.

DESCRIPTION OF THE PREFERRED EMBODIMENT

SYSTEM OPERATION

Figure 1:
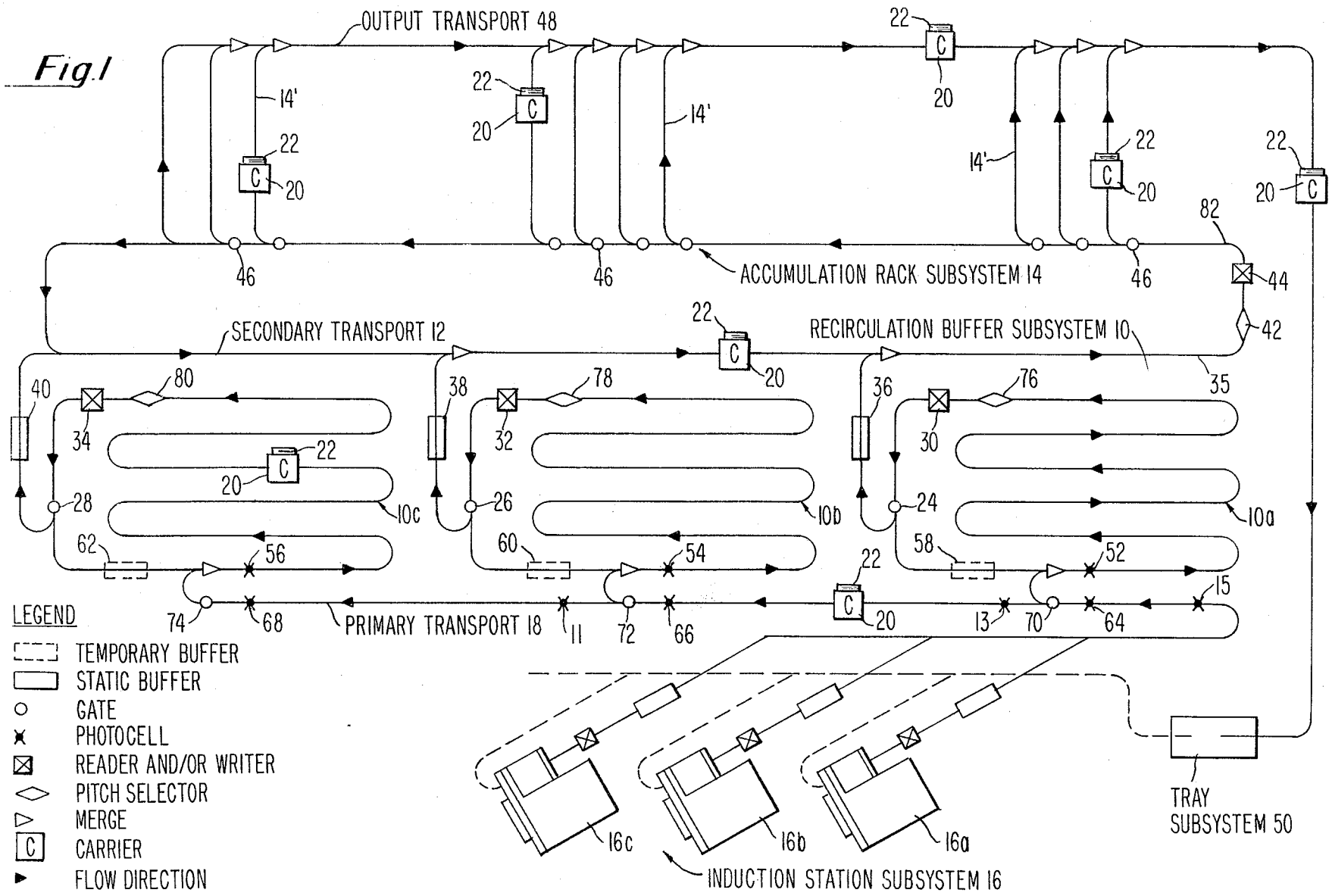
FIG. 1 is a diagrammatic illustration of the sequencing system of the present invention.

FIG. 1 comprises typical flow diagrams for the recirculation buffer subsystem 10, secondary transport loop 12 and output accumulation rack subsystem 14. An induction station subsystem 16 and its associated primary transport 18 are also depicted in schematic form. The organization and function of the induction station subsystem 16, primary transport 18, and recirculation buffer subsystem 10 are substantially the same as those of the referenced Ouimet et al. patent.

The carriers 20 which may be of the type described in the referenced Bradshaw et al. patent, and the respective mail pieces which they transport throughout the system of FIG. 1 are initially processed in the stations 16*a*, 16*b* and 16*c* comprising the induction station subsystem 16. Since the mail pieces are to be sequenced for local distribution, the postman's route identification number together with information to identify the sequence within the route, such as a mail-stop or street address, are written upon the magnetic media of the escort memories 22 which they bear. Also stored in each memory is the thickness of the individual mail piece. Similar data is entered into the system computer and is stored in tables of the carrier management software, to be described hereinafter.

The loaded carriers are then accumulated at the outputs of the induction station subsystem 16, and periodically released in batches to the primary transport 18 from which they ultimately enter the recirculating buffers 10*a*, 10*b* and 10*c*. In the latter, the carriers accumulate in a high density random order.

Under computer control, the carriers circulate in the recirculating buffers until either a predetermined stack size or number of carriers for a particular assigned route number are made to output the buffers. Routes selected for output by the computer are diverted at gates 24, 26 and 28 after the associated read/write stations 30, 32 and 34 where the thicknesses, and route numbers and mail stops of all of the carriers are read in search of the selected routes. The number of a particular output accumulation rack 14' within the accumulation rack subsystem 14, together with the sequence number of the document in that rack is written on each carrier memory at the last mentioned read/write station depending on its route number and mail stop. Documents destined for the same mail stop or address have consecutive sequence numbers assigned thereto based upon route mail stop and route sequence tables, described hereinafter. The carriers to be outputted are then diverted onto the secondary transport loop 12 at regular intervals via the static buffers 36, 38 and 40 associated respectively with the recirculating buffers 10*a*, 10*b* and 10*c*.

When a predetermined number of carriers, or alternately, a predetermined thickness of a stack of carriers is diverted from the recirculation buffer subsystem 10, the computer eliminates the destined route number from a queue, as explained in detail hereinafter, thereby inhibiting any further flow of carriers for that destination into the output stream.

The carriers circulate by means of a belt around the secondary transport loop 12. A pitch selector 42 located within the loop alternately restrains and permits the carriers to advance in order to achieve a spaced-apart configuration. The spaced carriers then pass a read station 44.

As noted hereinbefore, sequencing of the mail pieces within a preselected route takes place in the secondary transport loop 12 which is designed to have a transit-time substantially less than that of the recirculating buffer subsystem 10. In the simplest case, only those carriers destined for a single postman's route will be permitted to enter the secondary loop 12 for sequencing. The output accumulation rack number and the sequence number within that rack of a given carrier are decoded by the reader 44. These are compared with the sequence number being pointed to by a register associated with that output rack and appearing in the control system. If the sequence number overwritten in the carrier's escort memory corresponds to that in the register, the carrier is diverted under local control to the appropriate output accumulation rack 14' to build upon the desired sequence. Gates 46 are actuated at the proper time to intercept the carrier and divert it into the proper output accumulation rack 14'. The sequence register is then incremented to point to the next number in the sequence.

Conversely, if the data read by reader 44 indicates that the carrier 20 is not immediately needed to build upon the sequence being established, the carrier will be permitted to bypass all of the output accumulation racks 14' as it makes one or more complete cycles around the secondary transport loop 12. Each time it passes read station 44, a decision is made relative to a particular output rack and its associated register as to whether or not it is needed to build upon a sequence. Ultimately, the carrier 20 and the document it transports is diverted into the appropriate output accumulation rack 14'. It should be observed that while a single output rack 14' may be assigned by the computer for accumulating a sequenced batch of mail pieces for a specified route, the sequencing within the secondary transport loop 12 may be speeded by assigning respective sequential segments of the route to a plurality of output racks 14'. This has the effect of decreasing the number of revolutions of the carrier batch in the secondary transport loop to build the sequence.

When the sequence is complete, the output accumulation rack 14' is swept of carriers. If several racks of sequential segments of the route are involved, the segments are combined in the proper order by the sweeping operation. In either event, the carriers 20 are removed from the output accumulation racks 14' and placed upon an output transport 48 which carries them to a tray subsystem 50.

The recirculation buffer subsystem 10, the reentrant secondary transport 12, the control system and associated software will now be considered in greater detail.

RECIRCULATION BUFFER SUBSYSTEM

The recirculation buffer subsystem 10 comprises a plurality of storage buffers, 10*a*, 10*b* and 10*c* which permit carrier accumulation for the purpose of selecting batches to be outputted to the secondary transport 12.

Photocells positioned respectively in the recirculating buffers at points 52,54 and 56 monitor the buffers' ability to accept batches from the primary transport 18. When batch insertion is to be made into one of the recirculating buffers, the following sequence takes place automatically.

Temporary buffers will be created at respective locations 58, 60 and 62 based on which recirculating buffer is about to receive the batch. The purpose of this temporary buffer is to inhibit recirculation in the buffers 10*a*, 10*b* and 10*c* for the period required to complete batch insertion without interrupting the flow at 24, 26 or 28. Inhibiting of carrier flow at locations 58, 60 and 62 is accomplished by energizing a solenoid in each of the temporary buffers.

Photocells 64, 66 and 68 at each recirculating buffer entry point detect the leading edge of a batch before arrival at diverting gates 70, 72 or 74. These photocells signal the control system to divert the appropriate buffer gate within the space provided between batches.

The batch is then diverted from the primary transport 18 and is merged into the recirculating buffer 10*a*, 10*b* or 10*c*. Completion of insertion is detected and permits de-energization of inhibit solenoids in buffers 58, 60 and 62 and the reinstatement of gates 70, 72 or 74 to their non-diverting position.

The recirculating buffer is a serpentine arrangement of friction drive belts which has the ability to drive carriers in a non-positive manner. This arrangement of belts then has the ability to slip in respect to accumulated carriers, when flow is inhibited. The pitch selectors 76, 78 and 80 alternately restrain and permit advancement of the carrier, thereby converting the close-packed batch input flow into single carrier, spaced output flow. The pitch selectors operate continuously to dispense carriers and therefore create an intermittent recirculation within the buffer.

Carriers 20 to be outputted from the recirculating buffers are gated at points 24, 26 and 28 if they form part of the route destination queue. All remaining carriers re-enter the buffer in a spaced condition, and accumulate in a close-packed condition at the end of the storage line.

The function of the reader portion of the read/write stations 30, 32 and 34 on the output sides of the pitch selectors 76, 78 and 80 is to determine what route number, mail stop and document thickness is stored on the carrier escort memory card 22. This information is supplied to computer 84 (FIG. 2), where the route number of the carrier is compared with the list of route numbers, which have met predetermined outputting criteria stored in the computer software. If a carrier is bound for a destination selected for output, the writer portion of the last mentioned read/write stations is used by the computer to enter on the carrier's escort memory card 22 the number of an assigned output accumulation rack 14' and the sequence number within that rack.

The control system uses the magnetic card information to operate diverting gates 30, 32 and 34 at the proper time to divert carriers into static buffers 36, 38 and 40. The last mentioned buffers are designed in a manner that permits batches of carriers to enter into the secondary transport loop 12 at regular intervals, while at the same time allowing the process of carrier diversion into these buffers to continue. Batches exiting from all recirculating buffers 10*a*, 10*b* and 10*c* are merged in the secondary transport loop 12.

SECONDARY TRANSPORT

In contrast to the secondary transport of the referenced Ouimet et al. patent which is open-ended, the secondary transport 12 utilized in the present system makes use of a reentrant connection, whereby the end of the secondary transport is caused to enter the beginning thereof. This results in a short transit-time loop wherein the cycle time of the secondary transport loop 12 is preferably less than the cycle time of the recirculation buffer subsystem 10.

The secondary transport 12 includes a flat belt 35 which accepts carriers singly or in batches from the static buffers 36, 38 and 40. The recirculating buffers are under local control and output at regular intervals onto the secondary transport 12. The timing is arranged such that a space is reserved on the belt for each buffer to merge onto the transport without colliding with the upstream buffer outputs. The space allocated on the belt is sufficient to accommodate the contents of the static buffers, plus a separation distance required for merging.

The carriers 20 proceed along the secondary transport path to pitch selector 42 where the carriers are spaced apart on a timing belt 82, which traverses all of the gates 46 at the respective entrances to the output racks 14', thereby completing the secondary transport loop. At this time, the carrier escort memories are read by reader 44, and the sequencing of the items being transported commences. In practice, the route being sequenced may be divided into sequential segments, each of which is assigned to an output accumulation rack 14'. Sequencing by parts is then accomplished by repeatedly cycling the secondary transport until all items are in segment order. Segments are then combined in the sweeping operation.

In accomplishing the foregoing, the read station 44 decodes the accumulation rack number and sequence number in the rack for each document. As described in detail in the SYSTEM OPERATION, a decision is made as to whether a given document should be diverted to an output rack to build the desired sequence or allowed to circulate around the secondary transport loop for subsequent attempts at building the sequence. If the decision is made to output a carrier to an accumulation rack, the reader 44 utilizing local controls, will perform this function. Gates 46 are actuated at the proper time to intercept the carrier and divert it into the output accumulation rack 14'.

CONTROL SYSTEM

The control system for the present sequencing system is similar to that of the referenced patents. Some of the functional elements of the control system are centrally located, while others are concentrated locally in specific subsystems, and still others are distributed throughout the system.

Figure 2:
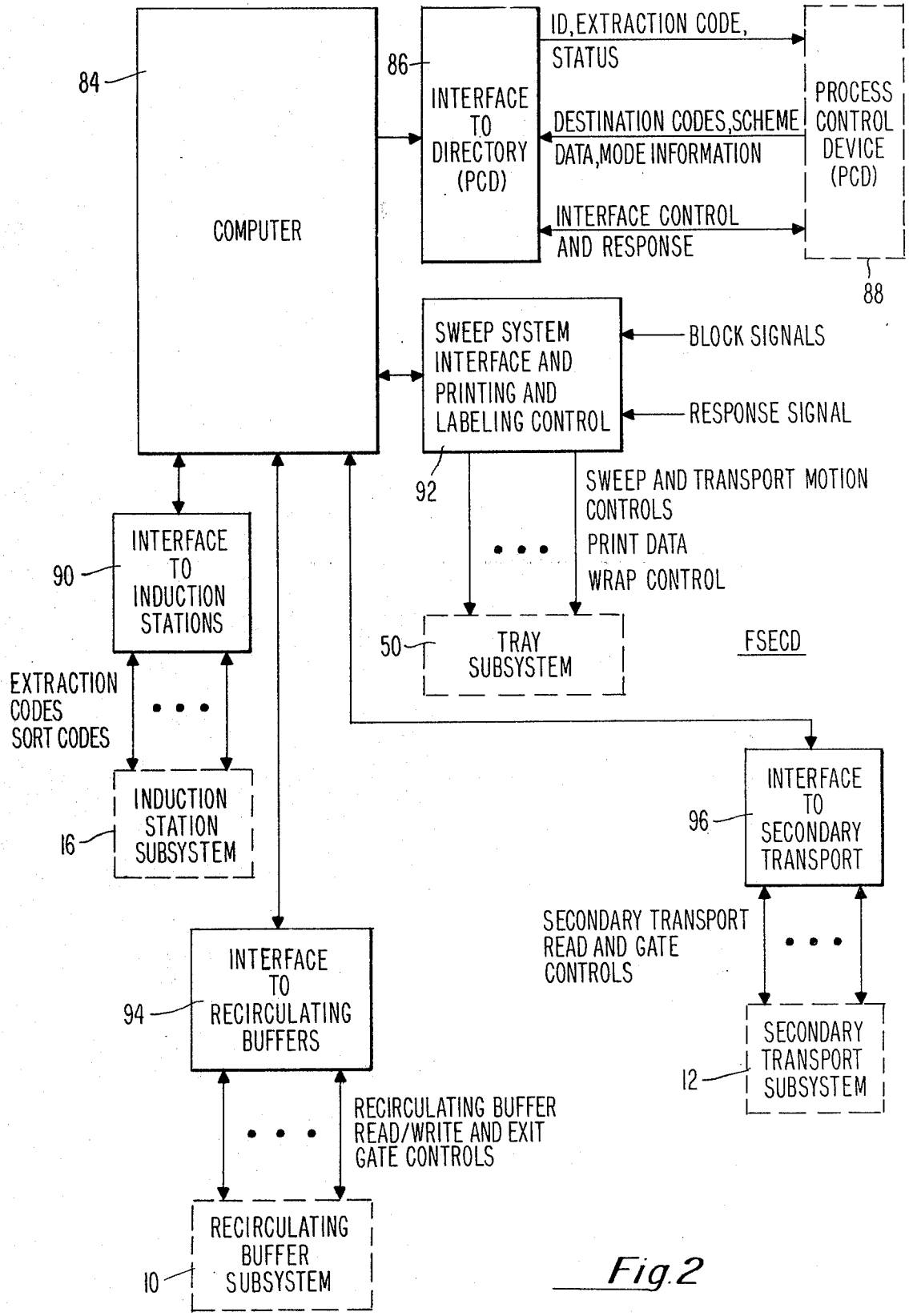
FIG. 2 is a block diagram of the controls used in the system of FIG. 1.

The Flats Sorting Equipment Control Device (FSECD) illustrated in FIG. 2 synchronizes and unites the remainder of the control system into an integrated whole. A computer 84 provides the FSECD with the ability to flexibly communicate data and commands between the constituents of the system via interface 86 and the Process Control Device (PCD) 88 external thereto.

The computer 84 also performs data translation such as that required to convert sequencing information (route numbers and mail stops) received from the PCD into the coded form required by the sequencing mechanisms. The latter are sent via interface 90 to the induction station subsystem 16. The computer 84 controls execution of orders from the PCD, such as special commands to output route destinations to meet requirements not under local control. Additionally, sweep and transport motion controls, print data, and wrap control are provided via interfere 92 to tray subsystem 50. The computer also controls by prearranged criteria, such as document quantity per postman's route, accumulated thickness per route, and time since the route was last outputted, the process of outputting to the secondary transport loop 12 selected carriers from the recirculating buffers. This is accomplished by way of interface 94 coupled to the recirculation buffer subsystem 10 and implemented by control of the read/write stations 30, 32 and 34 and exit gates 24, 26 and 28.

Additionally, in connection with the sequencing function, the computer 84 controls the process of sequencing the carriers outputted to the secondary transport loop 12 and the assignment of one or more output accumulation racks 14' to receive the sequenced carriers. This is accomplished by way of interface 96 coupled to the secondary transport subsystem loop 10 and implemented by control of the read/write station 44 and gates 46, in conjunction with sequence number registers associated with the output racks and counters for carrier tracking.

As to the local controls which are pertinent to the present system, these involve the recirculation buffer subsystem 10, the primary transport 18, and the secondary transport loop 12. Photocells 11, 13 and 15 and gates at points 70, 72 and 74 (FIG. 1) control input groups of carriers from the primary transport 18 such that the recirculating buffers 10*a*, 10*b* and 10*c* will be without physical interference among the carriers. Each recirculating buffer contains local controls in the form of pitch selectors 76, 78 and 80 to release spaced single carriers into the read/write stations 30, 32 and 34 and static buffers 36, 38 and 40 to merge diverted carriers into the secondary transport loop 12. In the latter loop, the reader 44 will cause the gates 46 to divert carriers under local control to the appropriate output racks 14'.

SOFTWARE

A substantial portion of the software and system control described in the referenced patents is applicable to the present system. However the sequencing function entails new elements of software for the control of the recirculation buffer subsystem and secondary transport loop.

Figure 3:
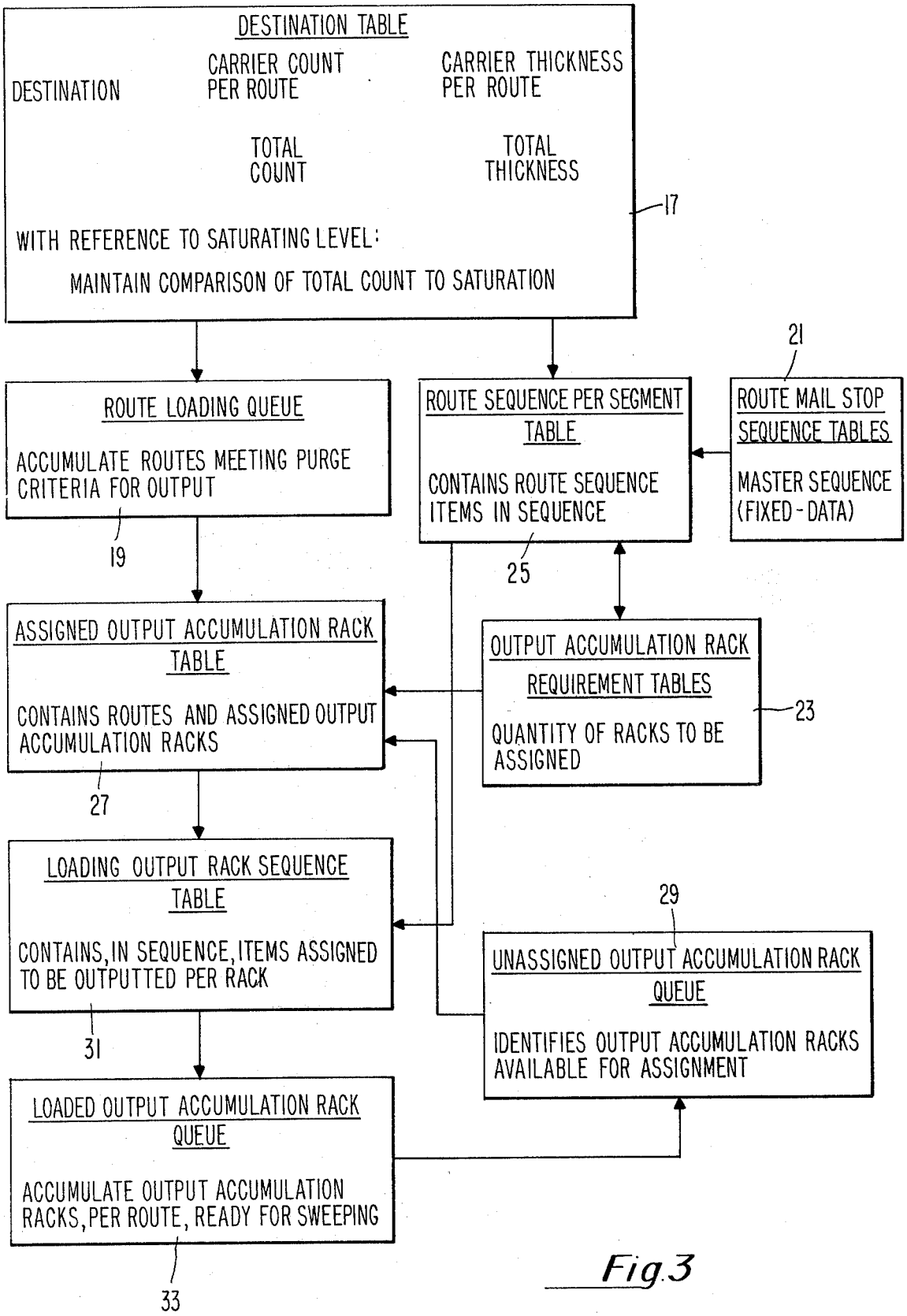
FIG. 3 illustrates the carrier management queue tables which comprise a basic software program for operating the system.

With specific reference to the simplified carrier management queue tables illustrated in FIG. 3, it is assumed that document data such as route number, sequence number or mail-stop within the route, (or equivalent information) as well as the document thickness is encoded in the escort memory of the carrier transporting the document. This information is stored in the Destination Table 17. This table lists and holds the count and accumulated thickness of the documents per route as well as the total count and thickness of all of the documents in the recirculation buffer subsystem 10. It is from this reservoir of documents that according to a predetermined criteria, a decision is made by computer 84 to exit documents belonging to an assigned route.

When a route is ready to be sequenced, either by demand or by virtue of its having attained a predetermined count or thickness, the data relating to the individual items in that route is transferred from the Destination Table 17 to the Route Sequence per Segment Table 25. Since Table 17 is decremented as Table 25 is incremented with data therefrom, the accountability for the individual documents in the selected route has effectively been transferred to the latter table. Concurrently, the fixed data representing a master sequence as contained in the Route Mail Stop Sequence Table 21 is applied to the data in the Route Sequence per Segment Table 25. Also, the number of output accumulation racks needed to accommodate the respective segments of the route being sequenced, as derived from the Output Accumulation Rack Requirement Table 23 are applied to the carrier data in the Route Sequence per Segment Table 25. The computer 84 now organizes the individual items of the route selected for output by providing within the Route Sequence per Segment Table 25, a listing of the sequenced items per output rack. Thus far, the grouping of the sequenced items into output racks has not involved the actual physical designations of the racks, but merely an organization based upon the expected number of racks needed to accommodate the route items.

In order to designate the actual output racks to receive the sequenced items, the route number or numbers desired to be outputted are transferred from the Destination Table 17 to the Route Loading Queue 19. Each route number is subsequently transferred in turn to the Assigned Output Accumulation Rack Table 27. At the same time, the number of required output racks appearing in the Output Accumulation Rack Requirements Table 23 is transferred to the Assigned Output Accumulation Rack Table 27. Also applied to the latter table is a designation of the output racks available for assignment, as contained in the Unassigned Output Accumulation Rack Queue 29.

The Assigned Output Accumulation Rack Table 27 now has a quantity of physical unassigned output racks, designated, for example, by rack number for the task at hand. The latter includes the sequencing of a desired route and the organization of the route into a quantity of segments. The output racks are in effect awaiting their assignment in accordance with the groupings of sequenced items previously accomplished within the Route Sequence per Segment Table 25.

The sequenced and segmented item queues from the last mentioned Table 25 are placed in the Loading Output Rack Sequence Table 31 along with the assigned output racks from the Assigned Output Accumulation Rack Table 27. The merger of such data into Table 31, results in the sequenced items being assigned to physical output racks in accordance with the segments into which the route has been broken. In effect, individual document accountability within the system has been transferred from the Route Sequence per Segment Table 25 to the Loading Output Rack Sequence Table 31.

Items, for example documents, belonging to the route being sequenced now start emerging from the recirculation buffer subsystem 10 onto the secondary transport loop 12, in the manner described hereinbefore. As the documents circulating in the secondary transport loop are transferred to the assigned output accumulation racks in sequential order, the queues of such documents appearing in the Loading Output Rack Sequence Table 31 are decremented accordingly. Individual document accountability shifts from the last mentioned table to the Loaded Output Accumulation Rack Queue 33. When the output accumulation racks assigned to the selected route are all loaded, the document queues in Table 31 will be reduced to zero.

At this time, the Loaded Output Accumulation Rack Queue 33 contains an identification of the output racks to be swept as well as information relating to the order in which they are to be swept to achieve the overall sequential arrangement of documents. This data remains in Table 33 until a sweep subroutine has been implemented. As the output accumulation racks are swept clear of documents, the racks become available for future assignment, and are so identified in the Unassigned Output Accumulation Rack Queue 29.

In conclusion, a sequencing system characterized by efficiency in its article throughput has been described. Although the system finds special application in mail processing, other articles, for example, large numbers of books having random classifications, may be conveniently sequenced for placement on library shelves. It should be understood that changes and modifications may be necessary in the system taught herein for particular applications. Such changes and modifications, insofar as they are not departures from the true scope of the invention are intended to be covered by the following claims.

What is claimed is:

1. A system for sequencing articles including mail comprising in combination:

carriers coupled to said articles for providing support therefor and remaining therewith throughout the operation, escort memory means attached to each of said carriers and adapted to receive information regarding at least the destination route and stop to which the article is to be delivered;

an induction station subsystem including write station means for storing said information in the escort memory means of each of said carriers;

a recirculation buffer subsystem comprised of at least one recirculating buffer for circulating carriers bound for random routes and stops, thereby providing temporary storage therefor;

primary transport means for transporting said carriers from said induction station subsystem into said recirculating buffer;

control system means coupled to said induction station subsystem for establishing a route destination queue encompassing all of the loaded carriers in the system, and in accordance with predetermined criteria, for selecting carriers associated with a particular route to be outputted from the recirculating buffer;

read/write means situated within said recirculating buffer and so positioned with respect to the path of travel of said carriers as to read the route and stop of each carrier as contained in its escort memory;

an output accumulation rack subsystem having a plurality of individually identifiable output racks;

secondary transport means having a reentrant configuration and transporting said carriers from said recirculation buffer subsystem to said output accumulation rack subsystem;

said read/write means within said recirculating buffer being coupled to said control system means and being directed thereby to overwrite the escort memory of the carriers selected to be outputted from the recirculating buffer with information identifying at least one particular output rack and their order within said last-mentioned rack;

gate means within said recirculating buffer responsive to the overwrite action of said read/write means for permitting said selected carriers to exit said recirculating buffer and to enter said secondary transport means;

read station means situated along said secondary transport means for reading the output rack and order information stored in the escort memory of each carrier, said read station means being operatively coupled to said control system means whereby a determination is made as to whether a given carrier should be directed to said particular output rack in accordance with the sequence being established therein or be permitted to circulate via said secondary transport means for successive readings by said read station means in respective attempts to build upon said last-mentioned sequence, and gating means situated within said accumulation rack subsystem and responsive to said read station means for causing said given carrier to enter and be stored in proper sequential order in said particular output rack.

2. A system as defined in claim 1 further characterized in that said secondary transport means has a short transit-time cycle compared to that of said recirculating buffer.

3. A system as defined in claim 2 wherein said control system means comprises a computer and a plurality of interface modules for communicating data and commands between the constituents of the system.

4. A system as defined in claim 3 further characterized in that said control system means includes means for segmenting said particular route, and for assigning output rack numbers to the respective segments as well as sequence numbers to the carriers within each rack as a function of the stop information contained in their respective escort memories, said read/write means within said recirculating buffer overwriting each escort memory with the output rack number corresponding to a segment of the route and the sequence number which the carrier will have within that output rack.

5. A system as defined in claim 4 wherein said control system means includes a queue for accumulating and storing the numbers of all of the output racks which have been loaded with carriers destined for said particular route, and which are awaiting sweeping and subsequent outputting from the system.

6. A system as defined in claim 5 further characterized in that said write station means in said induction station subsystem stores in the escort memory means of each of said carriers the thickness of the article being supported thereby in addition to its route and stop information, said write/read means in said recirculating buffer reading also said thickness data.

7. A system as defined in claim 6 wherein said route destination queue includes the route destination, stop and thickness of the article for each carrier, as well as the cumulative count and thickness of the articles per route and the total count and thickness of all of the articles being circulated in the recirculation buffer subsystem.

8. A system as defined in claim 7 further characterized in that said secondary transport means is comprised of at least a flat belt for receiving carriers from said recirculating buffer, said flat belt being coupled in a simple closed loop with a timing belt for delivering said carriers to said output racks.

9. A system as defined in claim 8 wherein said recirculating buffer is comprised of friction drive belts arranged in a serpentine configuration and characterized in that the path of carrier travel provided thereby is significantly longer than that provided by said secondary transport means.

10. A system as defined in claim 9 wherein said recirculation buffer subsystem comprises a plurality of recirculating buffers.

* * * * *